US005382072A

United States Patent [19]

Diefenbach

[11] Patent Number: 5,382,072

[45] Date of Patent: Jan. 17, 1995

[54] CHILD'S HIGHCHAIR

[75] Inventor: Berndt Diefenbach, Munich, Germany

[73] Assignee: Big-Spielwarenfabrik, Fuerth/Bayern, Germany

[21] Appl. No.: 12,158

[22] Filed: Jan. 27, 1993

[30] Foreign Application Priority Data

Jan. 28, 1992 [DE] Germany ..... 9200975

[51] Int. Cl.[6] ..... A47C 13/00

[52] U.S. Cl. ..... 297/1; 297/272

[58] Field of Search ..... 297/1, 3, 258, 270, 297/272, 32, 440, 440.1

[56] References Cited

U.S. PATENT DOCUMENTS

| | | | |
|---|---|---|---|
| D. 248,516 | 7/1978 | Johansson | 297/1 X |
| 2,494,045 | 1/1950 | Kauffman | 297/1 X |
| 2,622,658 | 12/1952 | Morgan | 297/258 X |
| 3,083,051 | 3/1963 | Milbourne | 297/32 X |
| 3,527,497 | 9/1970 | Self | 297/440 X |
| 3,556,586 | 1/1971 | Beardmore | 297/258 X |
| 4,160,564 | 7/1979 | Kyle | 297/270 X |
| 4,783,118 | 11/1988 | Ryan et al. | 297/258 X |

FOREIGN PATENT DOCUMENTS

| | | | |
|---|---|---|---|
| 0935661 | 6/1948 | France | 297/32 |

*Primary Examiner*—Kenneth J. Dorner
*Assistant Examiner*—Milton Nelson, Jr.
*Attorney, Agent, or Firm*—Jacobson, Price, Holman & Stern

[57] ABSTRACT

A child's highchair can be used as a highchair seat and, after tilting, as a topple-proof rocking chair. For this purpose, two generally triangular lateral frame parts are connected with each other by transverse struts. Two straight edges of the frame parts or two foot members or four corner points of the frame part define a base. Two lateral edges of the frame parts which extend from the base constitute the arcuatety curved runners of a rocking chair. A seat for use as a highchair and a seat for use as a rocking chair are mounted between the frame parts.

4 Claims, 1 Drawing Sheet

CHILD'S HIGHCHAIR

FIELD OF THE INVENTION

The invention relates to a child's highchair.

BACKGROUND OF THE INVENTION

A child's highchair as a rule is utilized for a single purpose of enabling a child to sit during mealtimes with grownups at a table whose height suits grownups but not children. Accordingly, a highchair only has, so far, a very limited field of application and when such a highchair is not in use adjacent to the table there is the problem of putting it away without it taking too much space.

SUMMARY OF THE INVENTION

Accordingly, one object of the present invention is to design a child's highchair which can be employed as a piece of furniture suitable for a child other than when being used with a table intended for use by adults.

In accordance with the invention this aim is to be achieved by a design in which two generally triangular lateral frame parts of the highchair are connected by transverse struts or the like, in that two straight edges of the frame parts or respectively two foot members or four edge points of the frame parts define a quadrilateral base, in that two lateral edges of the frame, which extend from the quadrilateral base part, constitute the arcuately curved runners of a rocking chair and in that between the frame parts, a seat for use as a highchair and/or a seat for use as a rocking chair is mounted. The highchair in accordance with the invention has dual uses in that on one hand is can be employed in a customary manner as a highchair so that a child may sit at such a height that it can easily use a table intended for adults, whereas on the other hand the highchair can be stood on the arcuately curved runners, which have so far constituted the arm rests of the highchair so that the highchair now has the function of a topple-proof rocking chair i.e. one which cannot be pushed over, in which a child can sit or almost lie and therefore be kept quiet. If the highchair is provided both with a highchair seat and with a rocking chair seat, no conversion is necessary in order to be utilized as a dual-purpose piece of furniture with the function of a highchair on the one hand and on the other hand as a child's rocking chair.

The lateral frame parts of the highchair may be in the form of boards or plates, but however the frame parts are best constituted by edge sections delimiting the same. In this respect it is possible for the sections to be molded or blown synthetic resin sections. The sections may be furthermore constituted by metal sections, as for instance steel sections. It is convenient for the sections to be tubular.

In accordance with a further advantageous development of the invention the sections constituting runners extend beyond the apex of the triangle, in which the runners join the edges or sections running from the quadrilateral base of the other sides of the triangle. It is in this manner that the stability with respect to toppling over, when utilized as a rocking chair, may be increased and at the same time it is possible for the extended runner parts to constitute upwardly extended arms rests, in the case of use as a highchair.

It is convenient furthermore for the ends, which are uppermost in the case of use as a highchair, of the runner-forming sections to be connected with each other by a transverse yoke. This transverse yoke may constitute the back rest and simultaneously function for the attachment of a back rest part extending as far as the back seat.

The highchair seat and the rocking chair seat may be permanently attached to the frame parts or, respectively, with the sections constituting the frame parts or with the transverse struts connecting the frame parts. However, it is possible as well for the seats to be detachably connected with the frame parts with the result that only one seat is necessary which may be arranged in accordance with the desired use. The seats may be connected by screw means or also be plug-in connections with the frame parts and/or the transverse struts.

Another advantageous feature of the invention is such that small tables and/or plug-in toys may be connected with the frame parts. They may simultaneously constitute safety holding means for the child using the seat with the result that the child may not tumble out of the chair unintentionally.

It is furthermore possible for safety belts for the child to be connected with the frame parts or the sections, such safety belts being convenient if no small retaining table or tray or inserts for toys are provided.

In accordance with a further development of the invention in the end part of the triangle sides constituting the rocking chair runners, freely rotatable wheels are provided which render it possible to easily move the rocking chair simply by lifting one side thereof.

One working embodiment of the invention will now be described with reference to the drawings.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
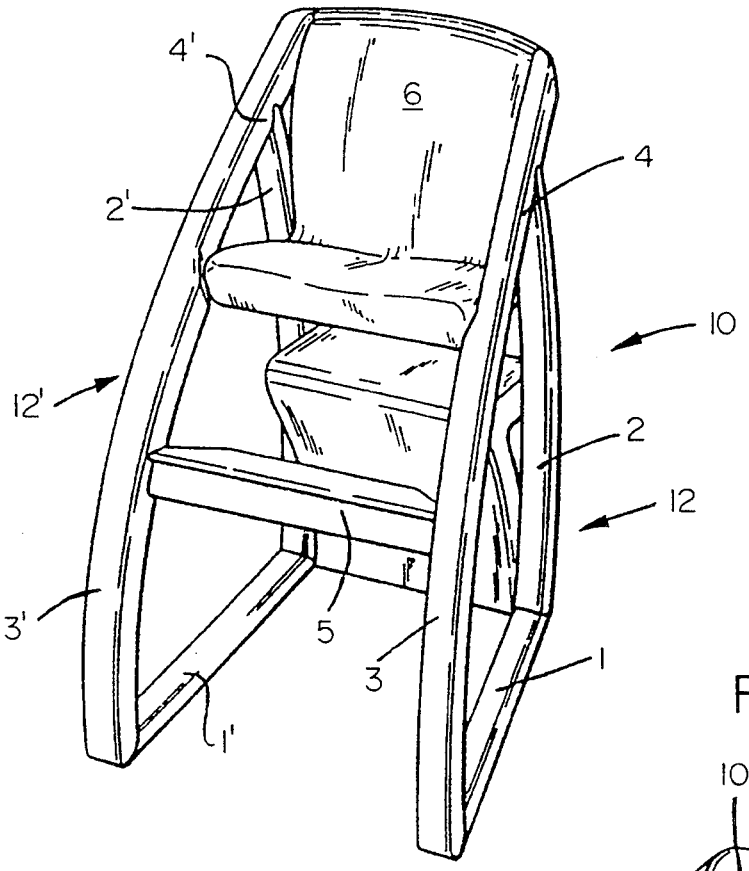
FIG. 1 is a perspective view of a child's highchair combined with a rocking chair while arranged for use as a highchair.
Figure 2:
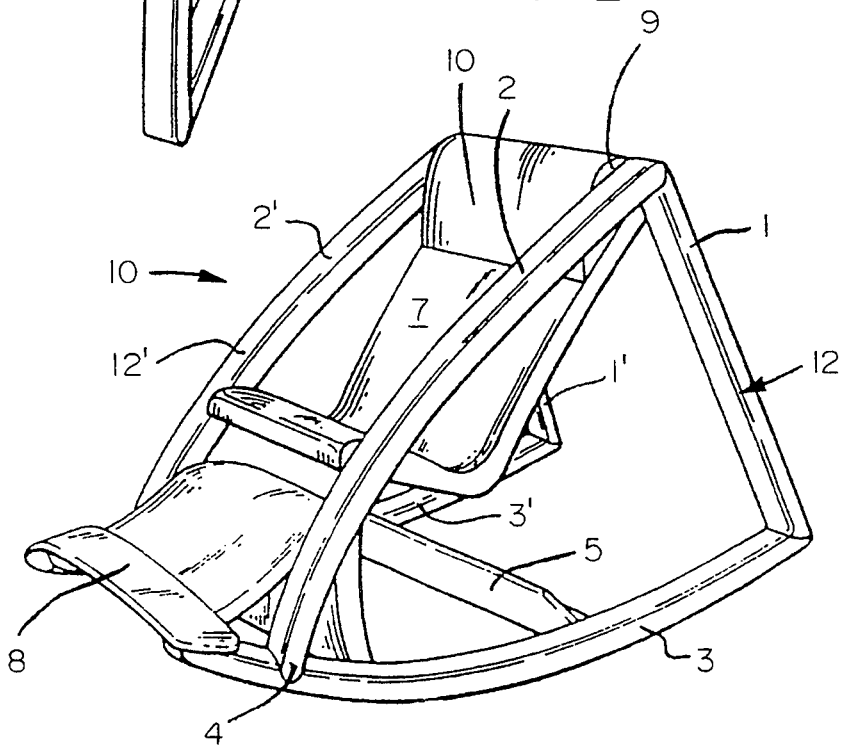
FIG. 2 is a perspective view of the piece of furniture in accordance with FIG. 1 in the case of use as a rocking chair.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

In the case of the dual-purpose piece of furniture 10 illustrated in the drawings, the side parts 12, 12' thereof consist of triangular frame parts, which are constituted by straight section members 1 and 1' and furthermore by arcuately curved section members 2 and 2' and also 3 and 3'. The beams 2, 3 and 2', 3' are connected with each other at the apexes 4 and 4' of the triangle. The sections 3 and 3' constituting runners of the rocking chair extend past the apexes 4 and 4' of the triangles and are connected at their extended ends by a transverse yoke 8.

The frames 1, 2, 3 and furthermore 1', 2' and 3' constituting the combined article of furniture are connected together by a transverse strut 5 which may be used as a footrest for a child when used as a highchair. Also a strut 9 interconnects the opposed intersection of section members 1, 2 and 1', 2', which serves as a support for the headrest 10 when used as a rocker.

Between the frame parts, a child's seat 6 is held for use as a highchair and on the opposite side or end there is a child's seat 7 for use as a rocking chair. The seats may comprise rigid boards or plates connected between the frame parts, yoke or struts, which simultaneously function as stiffening means for the seats.

Having described the invention, many modifications thereto will become apparent to those skilled in the art to which it pertains without deviation from the spirit of the invention as defined by the scope of the appended claims.

I claim:

1. A child's seating device comprising:

two generally triangular lateral frame parts connected with each other, at least one transverse strut connecting said lateral frame parts together, two straight sections of the frame parts defining a base, two arcuately curved sections of the frame parts extending from the base forming runners of a rocking chair, said two arcuately curved sections each having two ends with one of said two ends of said two arcuately curved sections connected to said two straight sections, a transverse yoke connecting together the other end of said two ends of said two arcuately curved sections, two additional sections of the frame parts extending from the base and intersecting said two arcuately curved sections at a distance from the other end of said two ends of said two arcuately curved sections, and a seat mounted between the frame parts for use in one of a highchair and a rocking chair with the seat positioned between the frame parts so that a portion of said two arcuately curved sections form arm rests and said at least one transverse strut forms a support for a back rest of the seat when the seat is positioned for use as a highchair.

2. The child's seating device as claimed in claim 1, wherein the sections are formed of synthetic resin.

3. The child's seating device as claimed in claim 1, wherein the sections are formed of metal.

4. The child's seating device as claimed in claim 1, wherein the seat is permanently connected with the frame parts.

* * * * *